US009935429B2

(12) United States Patent
Hanashi et al.

(10) Patent No.: US 9,935,429 B2
(45) Date of Patent: Apr. 3, 2018

(54) IGNITION CONTROL SYSTEM

(71) Applicant: DENSO CORPORATION, Kariya, Aichi-pref. (JP)

(72) Inventors: Ken Hanashi, Kariya (JP); Ryohei Akiyoshi, Kariya (JP); Tomoyuki Watanabe, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/690,756

(22) Filed: Aug. 30, 2017

(65) Prior Publication Data

US 2018/0062356 A1 Mar. 1, 2018

(30) Foreign Application Priority Data

Aug. 31, 2016 (JP) ..... 2016-169758

(51) Int. Cl.

| | |
|---|---|
| ***H01T 13/20*** | (2006.01) |
| ***H01T 13/32*** | (2006.01) |
| ***H01T 13/39*** | (2006.01) |
| ***H01T 21/02*** | (2006.01) |

(52) U.S. Cl.

CPC ..... *H01T 13/32* (2013.01); *H01T 13/39* (2013.01); *H01T 21/02* (2013.01)

(58) Field of Classification Search

USPC ..... 313/141, 118, 144

See application file for complete search history.

(56) References Cited

U.S. PATENT DOCUMENTS

| | | | | |
|---|---|---|---|---|
| 6,166,480 | A * | 12/2000 | Ishida | H01T 13/20 313/141 |
| 6,790,113 | B1 * | 9/2004 | Fujita | H01T 21/02 140/71.5 |
| 8,253,313 | B2 * | 8/2012 | Inoue | H01T 21/02 313/141 |
| 2001/0029916 | A1 | 10/2001 | Kanao | |
| 2002/0038992 | A1 | 4/2002 | Morita et al. | |
| 2002/0067111 | A1 * | 6/2002 | Shibata | H01T 13/32 313/141 |
| 2002/0108606 | A1 | 8/2002 | Miwa et al. | |
| 2003/0193282 | A1 | 10/2003 | Shibata et al. | |
| 2004/0061421 | A1 | 4/2004 | Morita et al. | |
| 2005/0016485 | A1 | 1/2005 | Miwa et al. | |
| 2005/0264151 | A1 | 12/2005 | Mori et al. | |
| 2007/0080618 | A1 | 4/2007 | Torii et al. | |
| 2009/0302733 | A1 * | 12/2009 | Nunome | H01T 13/39 313/141 |
| 2012/0252298 | A1 | 10/2012 | Hori et al. | |

(Continued)

FOREIGN PATENT DOCUMENTS

| | | |
|---|---|---|
| JP | 2008-294006 | 12/2008 |
| JP | 2012-089353 | 5/2012 |
| JP | 2012-256590 | 12/2012 |

(Continued)

*Primary Examiner* — Vip Patel

(74) *Attorney, Agent, or Firm* — Nixon & Vanderhye PC

(57) ABSTRACT

In the spark plug, at least one of the center chip and the ground chip is bonded with a center electrode or a ground electrode. The selected chip has a first part formed so as to linearly extend along a first center axis of an electrode bonded with the first part and a second part formed so as to extend linearly from a tip end of the first part along a second central axis inclined with respect to the first central axis.

8 Claims, 14 Drawing Sheets

(56) References Cited

U.S. PATENT DOCUMENTS

| | | | |
|---|---|---|---|
| 2013/0099652 | A1 | 4/2013 | Below et al. |
| 2013/0328476 | A1 | 12/2013 | Ban et al. |

FOREIGN PATENT DOCUMENTS

| | | |
|---|---|---|
| JP | 2014-229429 | 12/2014 |
| JP | 2017-146569 | 8/2017 |
| JP | 2017-183107 | 10/2017 |
| JP | 2017-183109 | 10/2017 |

* cited by examiner

IGNITION CONTROL SYSTEM

This application is based on and claims the benefit of priority from earlier Japanese Patent Application No. 2016-169758 filed on Aug. 31, 2016, the description of which is incorporated herein by reference.

TECHNICAL FIELD

This disclosure relates to a spark plug for an internal combustion engine.

BACKGROUND

A spark plug for igniting a gas mixture in a combustion chamber is included in an internal combustion engine. In the spark plug, spark discharge occurs between electrodes spaced apart from each other, thereby igniting the gas mixture.

Various shapes and positions of the electrodes of the spark plug have been proposed before. Japanese Unexamined Patent Application Publication No. 2002-324650 will be referred to as patent document 1. For example, a spark plug described in patent document 1 is provided with a center electrode having a center electrode chip and a ground electrode having a ground electrode chip. The center electrode is disposed inside of a mounting fitting, and the ground electrode is disposed on a tip end of the mounting fitting. In the spark plug, the spark discharge occurs between a tip end face of the center electrode chip and a tip end face of the ground electrode chip.

In the spark plug, a part of the ground electrode having the ground electrode chip is non-perpendicular to a center axis of the mounting fitting. Thus, a direction from the ground electrode chip to the center electrode chip is non-perpendicular to a center axis of the center electrode. In addition, the ground electrode chip extends from a side face of the ground electrode to the center axis of the center electrode.

In such a configuration, a wider space between the ground electrode and the center electrode is secured in comparison to a configuration where the ground electrode extends to a position above the center electrode (i.e. position where the center axis of the center electrode and the center axis of the ground electrode are overlapped). Therefore, it is possible to prevent a phenomenon in which flame kernel occurring at a vicinity of the center electrode contacts with the surface of the ground electrode and in which a growth of the flame kernel is inhibited from occurring, and it is possible to exhibit excellent ignition performance. In addition, in the above-described configuration, it is also possible to obtain an effect that heat dissipation properties of the ground electrode become sufficient because the ground electrode is shortened.

In patent document 1, the center electrode chip mounted on the tip end of the center electrode is disposed non-perpendicular to the center axis of the center electrode. Thereby, the tip end face of the center electrode chip and the tip end face of the ground electrode chip face each other in a mutually parallel state. In such a configuration, even when a part of the center electrode chip is consumed with an occurrence of the spark discharge, a distance between the center electrode chip and the ground electrode chip, that is a discharge distance, may be constant. As a result, ignition performance of the spark plug may be stably maintained over a long period.

Like the spark plug described in patent document 1, in the spark plug having a configuration in which the ground electrode is non-perpendicular to the center axis of the mounting fitting, there is a problem that chips are difficult to be welded to respective electrodes when the tip end faces of the chips face each other in a mutually parallel state. This is because an installation and a condition needed to weld the chips to the electrodes are different from conventional ones when a center axis of each of the chips is non-perpendicular to a center axis of each of the electrodes which is an object of bonding. It is preferable that the center axis of the chip in a bonding part is perpendicular to a bonding face of the electrode for easily welding the chip to the electrode.

SUMMARY

The present disclosure provides a spark plug which is capable of easily welding chips to the center electrode and the ground electrode. The spark plug has a configuration in which a ground electrode is non-perpendicular to a center axis of a mounting fitting and in which the tip end face of the ground electrode and the tip end face of the center electrode face each other in a mutually parallel state.

The spark plug according to the present disclosure is a spark plug for an internal combustion engine, and has a cylindrical mounting fitting, the center electrode, a center chip, a ground electrode and a ground chip. The center electrode is disposed along the center axis of the mounting fitting, and is mounted on the mounting fitting in an electrically insulated state relative to the mounting fitting. The center chip is projected from a part of the center electrode to outside of the spark plug. The ground electrode has a first end and a second end. The first end of the ground electrode is fixed by the mounting fitting. At least a part of the ground electrode is non-perpendicular to the center axis of the mounting fitting so that the ground electrode becomes closer to the center axis of the mounting fitting towards the second end of the ground electrode. The ground chip is projected from the part of the ground electrode to the center chip. The center chip is bonded with the center electrode, and the ground chip is bonded with the ground electrode. The center chip has a first part and a second part. The first part extends linearly along a first center axis of the center electrode. The first part has a first end and a second end, and the second end of the first part is bonded with the center electrode. The second part linearly extends from the first end of the first part along a second center axis which is non-perpendicular to the first center axis.

In such a configuration of the spark plug, the center chip has the first part and the second part whose directions of the center axes are different from each other. As a result, the whole of the center chip is formed in bent state. Therefore, a shape of the first part, which is a part bonded with the center electrode, may be suitable for welding work. In addition, a shape of the tip end of the second part, which is an origin of the spark discharge, may be suitable for improving ignition performance. The center chip has a first end and a second end. Shapes of the first end and the second end of the center chips may be determined independently of each other.

As an example of the shape of the first part as a shape suitable for welding work, for example, the end face of the first part at a position opposed to the center electrode is perpendicular to the first center axis. Thereby, the first part may be perpendicularly bonded with a bonding face of the center electrode. As an example of the shape of the second part as a shape suitable for improving ignition performance, for example, the end face of the tip end of the second part, which is opposed to the ground chip, is perpendicular to the second center axis. Thereby, tip faces of two chips (center chip and ground chip) are arranged in a mutually parallel state.

Incidentally, the second part extended from the first end of the first part may also be directly bonded with the tip end face of the first part, and may also be indirectly bonded with the first end face of the first part via another member which is made of one or more layers.

The present disclosure provides the spark plug which is capable of easily welding the chips to the center electrode and the ground electrode. The spark plug has the configuration in which the ground electrode is non-perpendicular to the center axis of the mounting fitting and in which the tip faces of the chips face each other in the mutually parallel state.

DETAILED DESCRIPTION OF THE PREFERRED EMBODIMENTS

Figure 1:
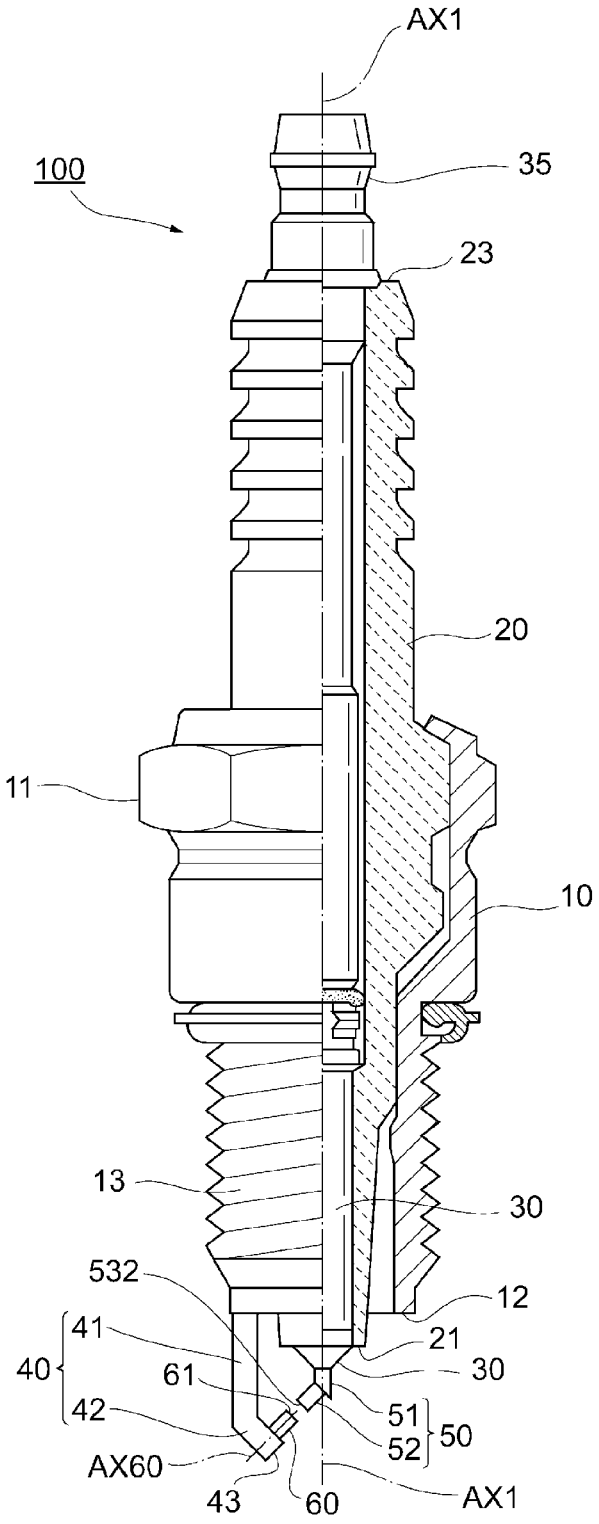
FIG. 1 shows an overall configuration of a partial sectional view of a spark plug according to a first embodiment of the present disclosure.

An embodiment of the present disclosure will be described below referring to the drawings. It should be appreciated that, in the each of the drawings, components identical with or similar to those in the first embodiment are given the same reference numerals, and repeated structures and features thereof will not be described in order to avoid redundant explanation.

A configuration of a spark plug 100 according to a first embodiment will be described below referring to FIG. 1. The spark plug 100 is an apparatus for producing a spark discharge in a combustion chamber of an internal combustion engine (not shown) and igniting gas mixture in the combustion chamber. The spark plug 100 has a mounting fitting 10, an insulator 20, a center electrode 30 and a ground electrode 40.

The mounting fitting 10 is a part mounted on the internal combustion engine. The entire mounting fitting 10 has a cylindrical shape, and the insulator 20 and the center electrode 30 described later are mounted therein. A male screw part 13 and a hexagonal nut part 11 are formed on an outside face of the mounting fitting 10. The male screw hole part 13 is inserted into a screw hole (female screw-processed hole on an internal wall face) formed on a wall of the internal combustion engine and is fixed. When the spark plug 100 is mounted on the internal combustion engine, a worker rotates the hexagonal nut part 11 using a tool such as a torque wrench, and fastens and fixes the spark plug 100 relative to the screw hole. When the spark plug 100 is mounted on the internal combustion engine, the center electrode 30 and the ground electrode 40 are arranged in the combustion chamber of the internal combustion engine.

The insulator 20 is a member for securing electrical insulation between the mounting fitting 10 and the center electrode 30. The insulator 20 is made of an alumina ceramic in the present embodiment. The entire insulator 20 has a cylindrical shape, and has the center electrode 30 therein. The insulator 20 is fixed relative to the inside face of the mounting fitting 10 in such a state that a center axis AX1 thereof is aligned with a center axis of the mounting fitting 10. An end 21 of the insulator 20 disposed at the combustion chamber side (upper side of FIG. 1) of the spark plug 100 is projected from an end 12 of the mounting fitting 10 to an outside of the spark plug (lower side of FIG. 1). In addition, an end 23 of the insulator 20, which is opposed to the end 21 disposed at the combustion chamber side is projected from the mounting fitting 10 to the outside of the spark plug (upper side of FIG. 1).

A terminal 35 has a first part and a second part. The first part of the terminal 35 for applying a voltage to the center electrode 30 is housed in the insulator 20. The second part of the terminal 35 is projected from the end 23 of the insulator 20 to the outside of the spark plug. A current flows from the terminal 35 to the center electrode 30 via a resistor.

The center electrode 30 is a member, which has a cylindrical shape, and is made of a nickel-based alloy having nickel as a main ingredient. The center electrode 30 is fixed in the insulator 20 in such a state that a center axis thereof is aligned with the center axis AX1 of the mounting fitting 10. That is, the center electrode 30 is arranged along the center axis AX1 of the mounting fitting 10. An end of the center electrode 30, which is disposed at the combustion chamber side, is projected from the end 21 of the insulator 20 to the outside of the spark plug (lower side of FIG. 1). As shown in FIG. 1, a part of the center electrode 30 projected from the end 21 of the insulator 20 has a taper shape whose diameter becomes smaller towards a tip end of the center electrode 30 (lower side of FIG. 1). The center electrode 30 is mounted on the mounting fitting 10 in an electrically insulated state.

A center chip 50 is mounted on the tip end of the part of the center electrode 30 projected from the end 21 of the insulator 20, which is opposed to the combustion chamber. The center chip 50 and a ground chip 60 described later are parts of an origin of the spark discharge, and the center chip 50 is mounted on the center electrode 30 so as to be projected from the part (tip end) of the center electrode 30. A concrete shape of the center chip 50 will be described later.

The ground electrode 40 is a member which is made of a nickel-based alloy having nickel as a main ingredient. The ground electrode 40 has substantially a prismatic shape. The ground electrode 40 has a first end and a second end. The first end of the ground electrode 40 is welded to the end 12 of the mounting fitting 10 disposed at the combustion chamber side, and is fixed. As shown in FIG. 1, a part of the end 12 of the mounting fitting 10 fixed to the ground electrode 40 is offset from the center axis AX1 of the mounting fitting 10. The tip end 43 of the ground electrode 40, which corresponds to the second end of the ground electrode 40, is projected from the end 12 of the mounting fitting 10 to the combustion chamber.

A center axis of a part in a vicinity of the end 12 of the ground electrode 40 that is a part given a reference numeral 41 of FIG. 1 is substantially arranged parallel relative to the center axis AX1 of the mounting fitting 10. A center axis of a part of the tip end 43 of the ground electrode 40 that is a part given a reference numeral 42 of FIG. 1 is non-perpendicular to the center axis AX1 of the mounting fitting 10. Specifically, the part given the reference numeral 42 is non-perpendicular to the center axis AX1 of the mounting fitting 10 so as to become closer to the center axis AX1 of the mounting fitting 10 towards the tip end 43 of the ground electrode 40. Incidentally, when viewing the ground electrode 40 along the center axis AX1 of the mounting fitting 10, the ground electrode 40 and the center axis AX1 of the mounting fitting 10 do not overlap each other.

A ground chip 60 is mounted on a vicinity of the tip end 43 of the ground electrode 40. The ground chip 60 of the present embodiment is a member which is made of a noble metal alloy including platinum as a base material, and has a cylindrical shape. A noble metal alloy including iridium as a base material may also be used as a material of the ground chip 60.

The ground chip 60 has a first end and a second end. The first end of the ground chip 60 is welded and fixed to a side face 421 of the ground electrode 40, which is disposed at a position opposed to the center axis AX1 of the mounting fitting 10. A center axis AX60 of the ground chip 60 is perpendicular to the side face 421 of the ground electrode 40. As a result, the ground chip 60 is projected from a part of the ground electrode 40 to the center chip 50. In addition, a center axis AX60 of the ground chip 60 is non-perpendicular to the center axis AX1 of the mounting fitting 10. A tip end face 61 of the ground chip 60, which corresponds to the second end of the ground chip 60, is perpendicular to the center axis AX60 of the ground chip 60, and is opposed to a tip end face 522 described later of the center chip 50.

A space where the spark discharge occurs is formed between the center chip 50 and the ground chip 60 which are separated from each other. A high voltage is applied between the mounting fitting 10 and the terminal 35 during an operation of the internal combustion engine. Thereby, the spark discharge occurs between the center chip 50 and the ground chip 60.

Figure 2:
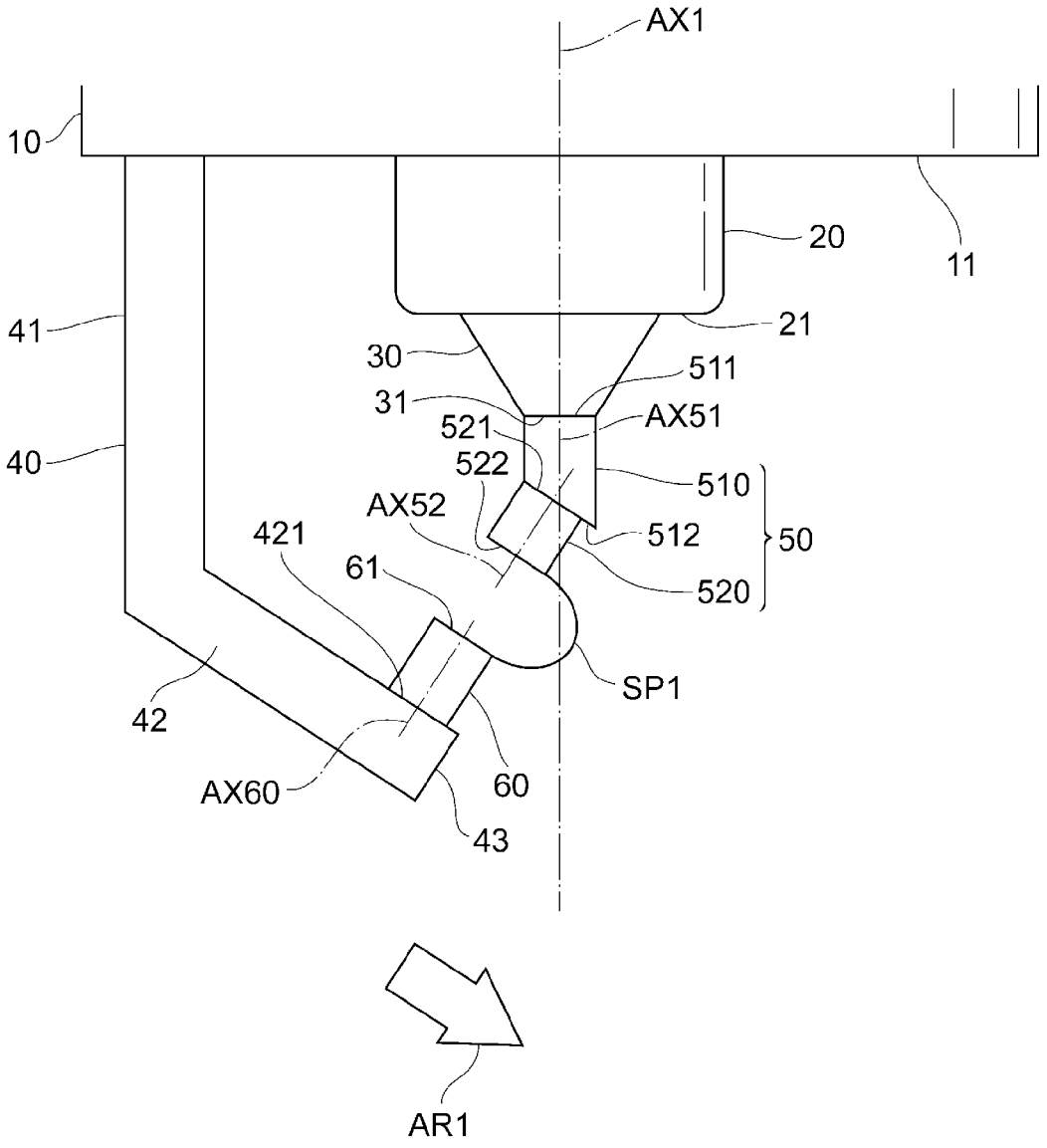
FIG. 2 shows an enlarged view of a part producing spark discharge in the spark plug shown in FIG. 1.
Figure 3:
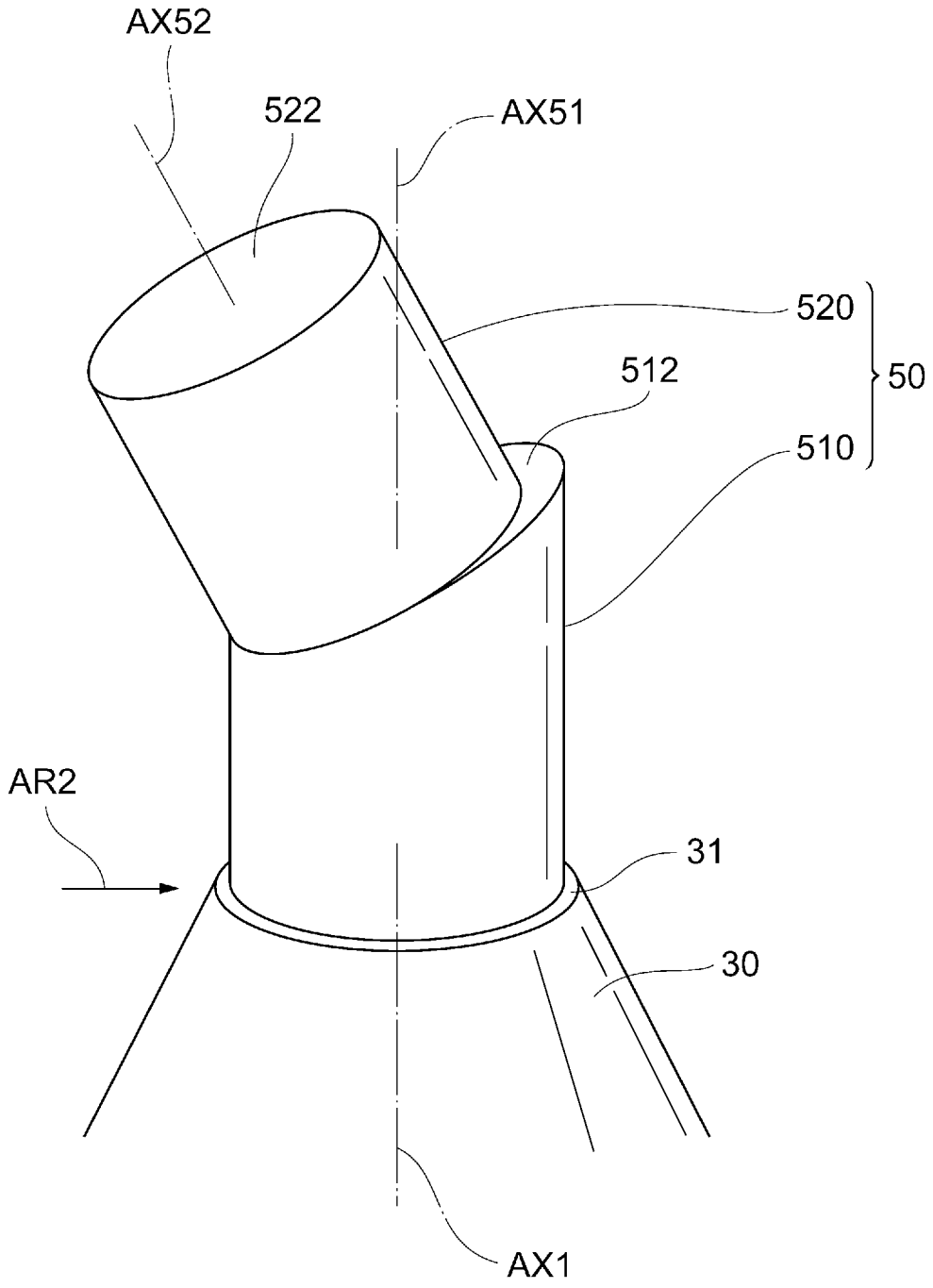
FIG. 3 shows a perspective view of a center chip of the spark plug.

A concrete shape of the center chip 50 will be described by referring to FIGS. 2 and 3. FIG. 2 shows an enlarged view of a part where the spark discharge occurs in the spark plug 100, in a vicinity of the center chip 50 together with the ground chip 60. FIG. 3 shows a perspective view of the center chip 50. Incidentally, the center chip 50 of FIG. 3 is drawn in such a state that a view shown in FIG. 2 is inverted vertically.

The center chip 50 has a first part 510 and a second part 520, and is formed by, for example, diffusion bonding the first part 510 and the second part 520. The first part 510 is a part of the center chip 50 disposed at the center electrode 30, and is a part bonded with a tip end face 31 of the center electrode 30. The first part 510 is made of an alloy including nickel as a base material in the same way as the center electrode 30. The first part 510 has an approximately cylindrical shape. The first part 510 linearly extends from the tip end face 31 of the center electrode 30 along a center axis AX51 of the first part 510. The center axis AX51 of the first part 510 is aligned with the center axis AX1 of the mounting fitting 10. The center axis AX51 of the first part 510 corresponds to a first center axis of the present embodiment.

The tip end face 31 of the center electrode 30 is perpendicular to the center axis AX1 of the mounting fitting 10. In addition, an end face 511 of the first part 510 disposed at the position opposed to the center electrode 30 (i.e. end face which is disposed apart from a second part 520) is perpendicular to the center axis AX51 of the first part 510. The first part 510 is welded and fixed in such a state that the end face 511 of the first part 510 is mounted on a center of the tip end face 31 of the center electrode 30. As a result, the first part 510 is connected with the tip end face 31 of the center electrode 30 so that the center axis AX51 thereof is perpendicular to the tip end face 31 of the center electrode 30.

A side face 512 of the first part 510 disposed at a position opposed to the second part 520 is non-perpendicular to the center axis AX1 of the mounting fitting 10 and the center axis AX51 of the first part 510. The side face 512 of the first part 510 is perpendicular to the center axis AX 60 of the ground chip 60. In other words, the side face 512 of the first part 510 and a side face 412 of the ground electrode 40 face each other and are mutually parallel.

The second part 520 is a part of the center chip 50 disposed at a position opposed to the ground chip 60. The second part 520 is a member which is made of a noble metal alloy (i.e. alloy including platinum) including platinum as a base material in the same way as the ground chip 60, and has a cylindrical shape. A noble metal alloy (i.e. alloy including iridium) including iridium as a base material may also be used as a material of the second part 520.

The second part 520 linearly extends from the side face 512 of the first part 510 along the center axis AX52 of the second part 520. Both the side face 521 of the second part 520 disposed at a position opposed to the first part 510 and the tip end face 522 of the second part 520 disposed at a position opposed to the ground chip 60 are perpendicular to the center axis AX52 of the second part 520. The center axis AX52 of the second part 520 is aligned with the center axis AX 60 of the ground chip 60. Therefore, the tip end face 522 of the second part 520 and the tip end face 61 of the ground chip 60 face each other and are mutually parallel. The center axis AX52 corresponds to a second center axis of the present embodiment.

Effects of the above-described configuration of the spark plug will be described below. As shown in FIG. 2, in the present embodiment, the tip end 43 of the ground electrode 40 does not extend to a position above the center electrode 30 (i.e. position where the center axis AX1 of a mounting fitting 10 and the ground electrode 40 are overlapped). Therefore, a wider space between the ground electrode 40 and the center electrode 30 is secured. Therefore, it is possible to prevent a phenomenon in which a flame kernel produced in a vicinity of the center electrode 30 contacts with the surface of the ground electrode 40 and in which a growth of the flame kernel is inhibited from occurring, and it is possible to exhibit excellent ignition performance. In addition, in the above-described configuration, it is possible to obtain an effect that heat dissipation properties of the ground electrode 40 become sufficient because the ground electrode 40 is shortened.

In a configuration where the ground electrode 40 is non-perpendicular to the center axis AX1 of the mounting fitting 10 like the present embodiment, airflow tends to flow along a direction of an arrow ARI of FIG. 2 by flowing the airflow in the combustion chamber along the ground electrode 40. A path of the spark discharge occurring between the center chip 50 and the ground chip 60 and shaped by the airflow is a path given a reference numeral SP1 of FIG. 2 that is a path extending to a space formed at a bottom right of the ground chip 60 of FIG. 2. The space formed at a bottom right of the ground chip 60 of FIG. 2 is kept free by a slope of the ground electrode 40. Therefore, in the present embodiment, a relatively large spark is easily formed, and the ignition performance of the spark plug 100 is improved.

In the present embodiment, the tip end face 61 of the ground chip 60 and the tip end face 522 of the center chip 50 face each other and are mutually parallel. Therefore, even when a part of the ground chip 60 or the like is consumed by an impact of the spark discharge, a distance between the center chip 50 and the ground chip 60 that is a discharge distance may be constant without changing. As a result, it is possible to stably produce the spark discharge, and the ignition performance of the spark plug 100 may be stably maintained over a long period.

The above-described configuration is a configuration in which the ground electrode 40 is non-perpendicular to the center axis AX1 of the mounting fitting 10 and in which tip end faces of chips of a center electrode and a ground electrode face each other in a mutually parallel. A configuration may also be considered which is different from the above-described configuration. For example, it is also considered that the tip end face 31 of the center electrode 30 may be non-perpendicular to the center axis AX1 of the mounting fitting 10 and a cylindrical tip is bonded with the tip end face 31 of the center electrode 30. In addition, it is also considered possible that an end face of the center chip 50 disposed at the position opposed to the center electrode 30, which is obliquely cut, may be bonded with the tip end face 31 of the center electrode 30.

However, in such a configuration, the center chip 50 needs to be welded to the center electrode 30 in such a state that it is non-perpendicular to the center electrode 30. Therefore, an installation and a condition needed to weld the center chip 50 to the center electrode 30 are different from conventional ones. As a result, there is a risk that welding work may be difficult to perform.

On the other hand, in the present embodiment, a part of the center chip 50 is disposed at the position opposed to the center electrode 30 that is the first part 510 as a part welded to the center electrode 30 which is perpendicular to the tip end face 31 of the center electrode 30. In addition, the first part 510 extends along a longitudinal direction (center axis AX1) of the center electrode 30. Therefore, as shown by the arrow AR2 of FIG. 3, a direction where a laser for welding the center electrode 30 is emitted is perpendicular to the center axis AX1 of the mounting fitting 10. In addition, when a welding position changes along a circumferential direction of the tip end face 31 of the center electrode 30, it is possible to maintain a welding direction and a height of a welded part (position disposed along the center axis AX1 of the mounting fitting 10). Furthermore, the center chip 50 is not inclined in the welded part, therefore, it is possible to perform welding equally over the whole circumferential direction of the tip end face 31 of the center electrode 30. As a result, in the present embodiment, it is possible to easily weld the center chip 50 to the center electrode 30 using the same procedure as a conventional one.

As described above, in the present embodiment, the first part 510 of the center chip 50 bonded with the center electrode 30 has a shape which is suitable for welding work. In addition, the second part 520 disposed at a position opposed to an origin of the spark discharge has a shape which is suitable for improving the ignition performance. That is, one of ends of the center chip 50 and the other one of the ends of the center ship 50 are determined independently respectively so as to have respectively shapes which are suitable for respective functions.

In addition, an effect of reducing an amount of a noble metal alloy used may be obtained by using a noble metal alloy which has high durability against the spark discharge, for a part of the center chip 50 other than the whole center chip 50.

Figure 4A:
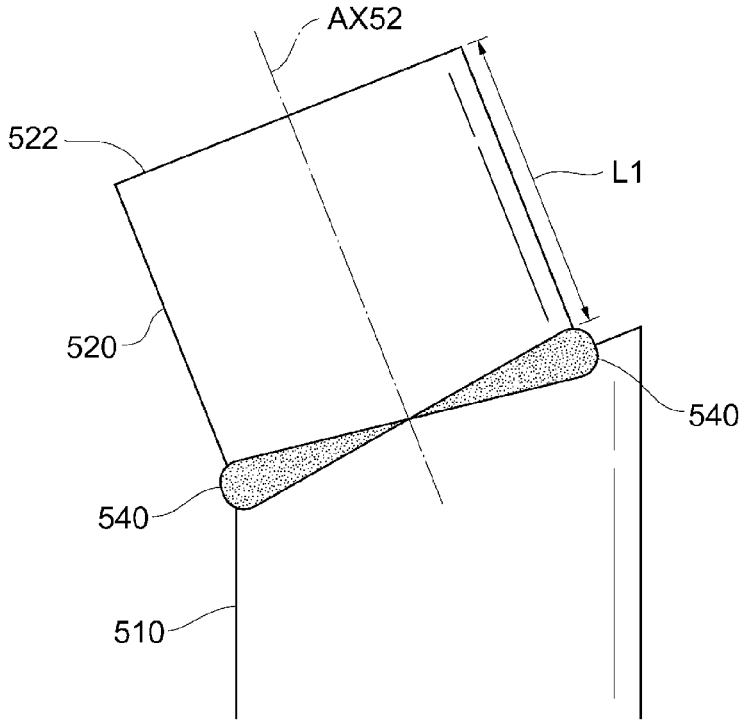
FIG. 4A and FIG. 4B show a diagram for explaining the center chip.

Incidentally, in the present embodiment, the first part 510 and the second part 520 are diffusion bonded with each other. Instead of the above-described aspect, it is also possible to weld the first part 510 to the second part 520. However, as shown in FIG. 4 (A), a length L1 of the second part 520 along the center axis AX52 of the second part 520 is liable to be shorter than an initial length of the second part 520 along the center axis AX52. This is because a melting part 540 melted by welding is formed between the first part 510 and the second part 520. The length L1 of the second part 520 is preferably secured to be sufficiently long from a viewpoint of widely securing an area which will be the origin of the spark discharge.

Figure 4B:
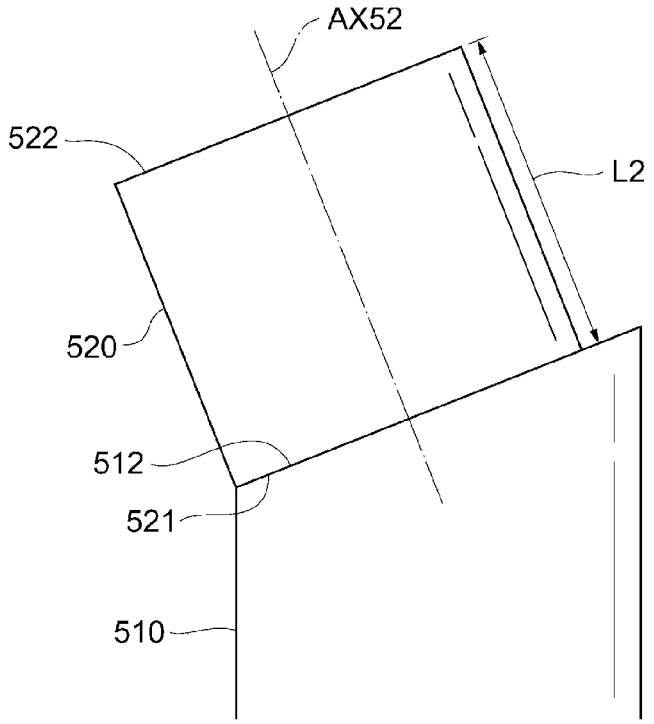

Like the present embodiment, if the first part 510 and the second part 520 are diffusion bonded with each other, the melting part 540 is not formed. As a result, as shown in FIG. 4(B), it is possible that the length of the second part 520 along the center axis AX52 of the second part 520 is a length 2 which is almost equal to the initial length of the second part 520 along the center axis AX52. Thereby, the ignition performance of the spark plug 100 is further improved.

Figure 5:
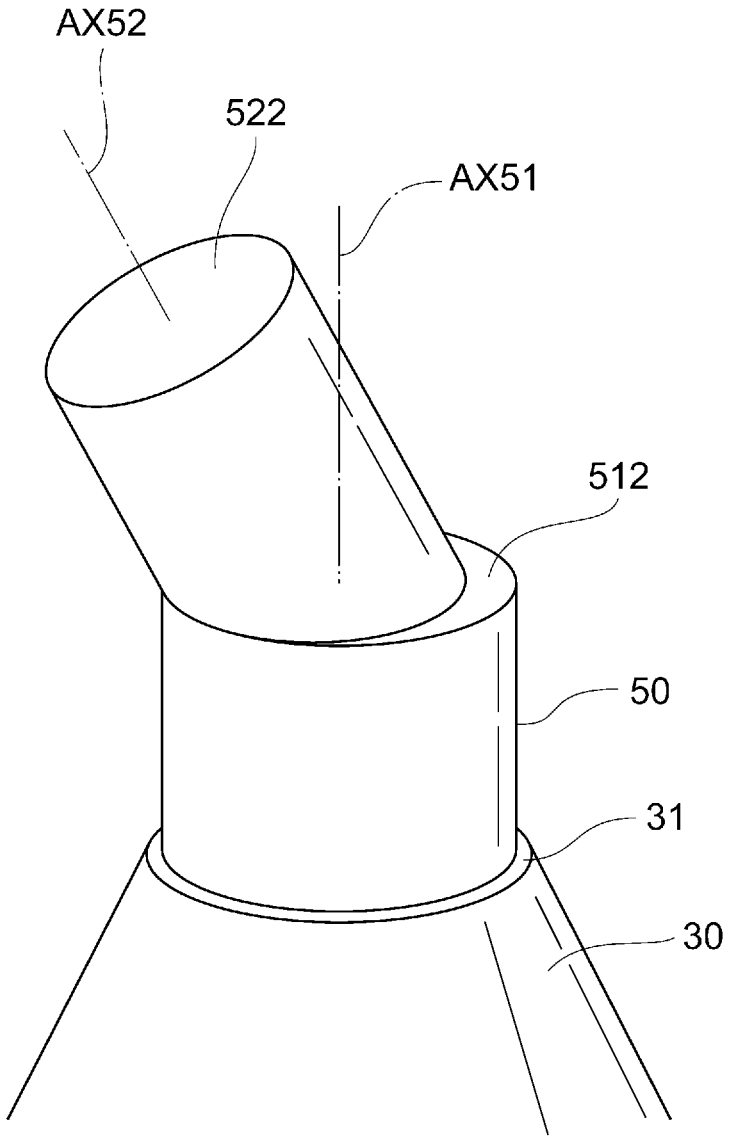
FIG. 5 shows a perspective view of a center chip of a spark plug of a modification of the first embodiment.

A modification of the first embodiment will be described below by referring to FIG. 5. A center chip 50 has a first part 510 and a second part 520. In this modification, an end face 512 of the first part 510 is perpendicular to a center axis AX51 of the first part 510. On the other hand, an end face 521 of the second part 520 that is a face bonded with an end face 512 is non-perpendicular to a center axis AX52 of the second part 520. Incidentally, a tip end face 522 of the second part 520 is perpendicular to the center axis AX52 of the second part 520 in the same way as in the first embodiment.

Like this modification, a configuration where the end of the second part 520 is obliquely cut instead of the first part 510 may also obtain the same effect as in the first embodiment. Incidentally, the second part 520 made of a noble metal has poor workability, therefore, like the first embodiment, it is preferable that the end of the first part 510 is obliquely cut.

A second embodiment will be described below by referring to FIG. 6. A spark plug 100 according to the second embodiment is different from the first embodiment in only a shape of a center chip 50*a*. Other configurations are the same as those in the first embodiment. Different points in the second embodiment compared to the first embodiment will be described below. Points that are the same as in the second embodiment and the subsequent embodiments will not be described in order to avoid redundant explanation.

The center chip 50*a* has a first part 510*a* and a second part 520*a*. In the present embodiment, the first part 510*a* and the second part 520*a* are respectively formed so as to have square prism shapes, not cylindrical shapes. The end face of the first part 510*a* disposed at the center electrode 30 (a part corresponding to an end face 511 in the first embodiment) is perpendicular to a center axis AX51 of the first part 510*a*. The first part 510*a* is welded and fixed in such a state that the end face of the first part 510*a* is mounted on a center of a tip end face 31 of a center electrode 30. As a result, the first part 510*a* is connected with the tip end face 31 of the center electrode 30 so that the center axis AX51 of the first part 510*a* is perpendicular to the tip end face 31 of the center electrode 30.

An end face 512*a* of the first part 510*a* disposed at a position opposed to the second part 520*a* is non-perpendicular to the center axis AX51 of the first part 510*a*. The end face 512*a* of the first part 510*a* is perpendicular to a center axis AX60 of a ground chip 60 in the same way as an end face 512 of a first part 510 in the first embodiment.

The second part 520*a* linearly extends from the end face 512*a* of the first part 510*a* along a center axis AX52 of the second part 520*a*. Both the end face of the second part 520*a* disposed at a position opposed to the first part 510*a* (a part corresponding to an end face 521 of a second part 520 in the first embodiment) and a tip end face 522*a* of the second part 520*a* disposed at a position opposed to the ground chip 60 are perpendicular to the center axis AX52 of the second part 520*a*. The center axis AX52 of the second part 520*a* is aligned with the center axis AX60 of the ground chip 60. Therefore, in the present embodiment, the tip end face 522*a* of the second part 520*a* and a tip end face 61 of the ground chip 60 face each other in a mutually parallel. In the above-described aspect, an effect similar to one described in the first embodiment may be obtained.

Figure 7:
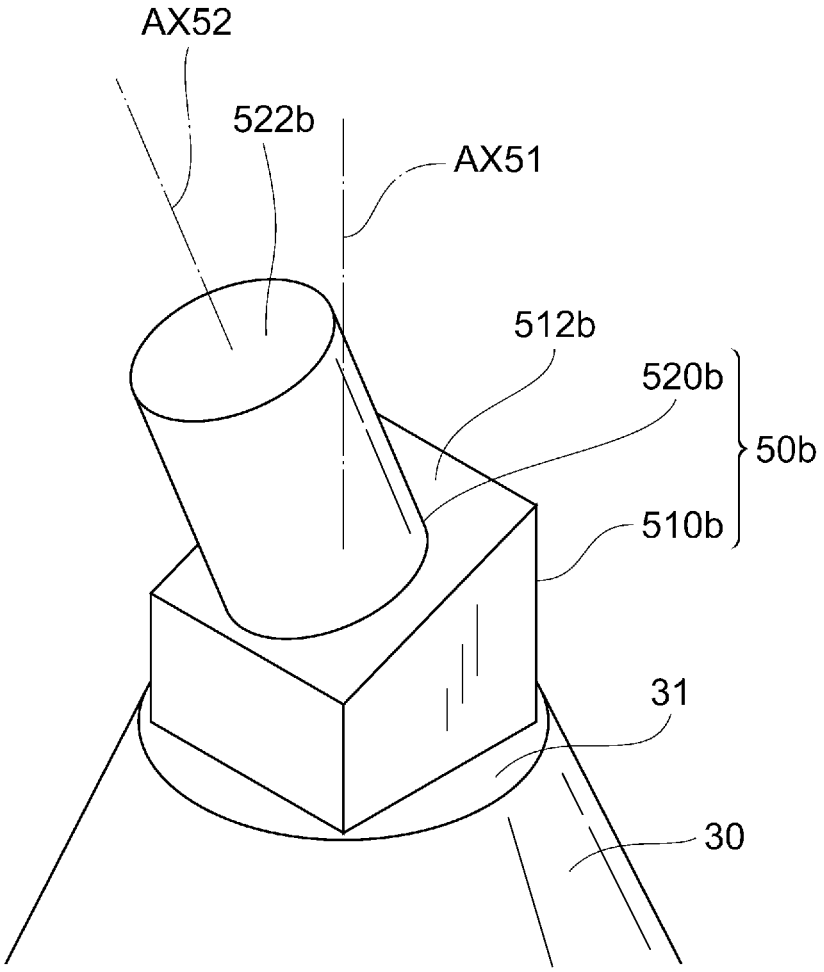
FIG. 7 shows a perspective view of a center chip of a spark plug according to a third embodiment of the present disclosure.

Referring to FIG. 7, a third embodiment will be described below. A spark plug 100 according to the third embodiment is different from the first embodiment in only a shape of a center chip 50*b*. Other configurations are the same as those in the first embodiment. Different points in the third embodiment compared to the first embodiment will be described below.

The center chip 50*b* has a first part 510*b* and a second part 520*b*. In the present embodiment, the first part 510*b* has a square prism shape, not a cylindrical shape, and a shape of the first part 510*b* is equivalent to a shape of a first part 510*a* in the second embodiment. On the other hand, the second part 520*b* has a cylindrical shape, and a shape of the second part 520*b* is equivalent to a shape of a second part 520 in the first embodiment. Therefore, an end face 512*b* of the first part 510*b* disposed at a position opposed to the second part 520*b* is non-perpendicular to a center axis AX51 of the first part 510*b*, and is perpendicular to a center axis AX60 of a ground chip 60. In addition, a tip end face 522*b* of the second part 520*b* disposed at a position opposed to the ground chip 60 is perpendicular to a center axis 52 of the second part 520*b*. A tip end face 61 of the ground chip 60 face each other in a mutually parallel. In the above-described aspect, an effect similar to one described in the first embodiment may be obtained.

Incidentally, in a shape of a center chip 50*b*, only the second part 520*b* disposed at a position opposed to the ground chip 60 may also have a square prism shape instead of that only the first part 510*b* disposed at a position opposed to a center electrode 30 has the square prism shape like the present embodiment. A cross-section shape of the first part 510*b* that is a cross-section face which is perpendicular to the center axis AX51 of the first part 510*b* may be an arbitrary shape. In addition, a cross-section shape of the second part 520*b* that is a cross-section face which is perpendicular to the center axis AX52 of the second part 520*b* may be an arbitrary shape.

Figure 8:
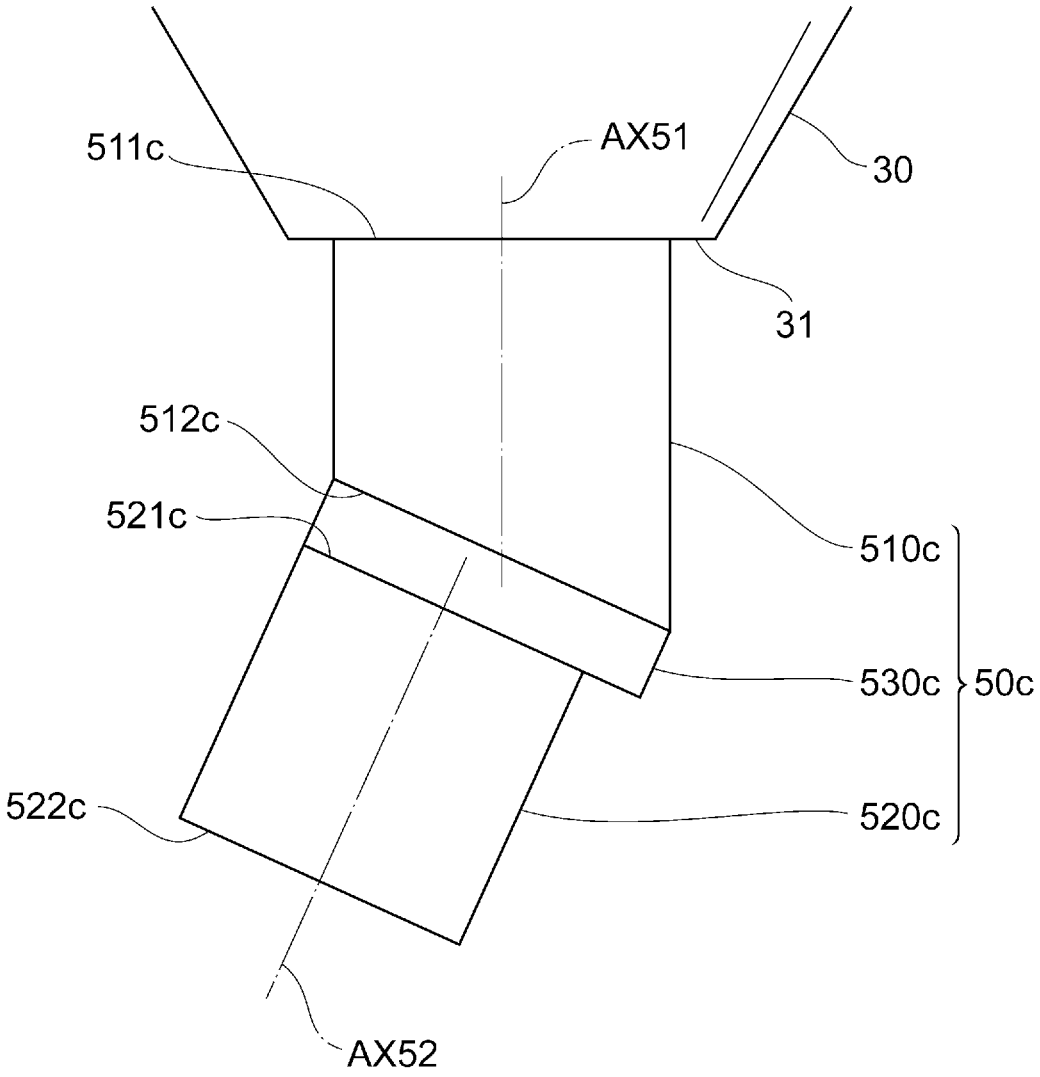
FIG. 8 shows a perspective view of a center chip of a spark plug according to a fourth embodiment of the present disclosure.

Referring to FIG. 8, a fourth embodiment will be described below. A spark plug 100 according to the fourth embodiment is different from the first embodiment in only a shape of a center chip 50*c*. Other configurations are the same as those in the first embodiment. Different points in the fourth embodiment compared to the first embodiment will be described below.

The center chip 50*c* has a first part 510*c* and a second part 520*c*. In the present embodiment, a middle layer 530*c* is formed between the first part 510*c* and the second part 520*c*. The middle layer 530*c* is respectively bonded with an entire end face 512*c* of the first part 510*c* and an entire end face 521*c* of the second part 520*c*. The middle layer 530*c* is made of a material that is different from both the materials of the first part 510*c* and the second part 520*c*. An alloy including both platinum and nickel is used in a material of the middle layer 530*c* of the present embodiment. As a result, a linear expansion coefficient of the middle layer 530*c* is smaller than that of the first part 510*c*, and is larger than that of the second part 520*c*. Heat stress between the first part 510*c* and the second part 520*c* occurred is moderated by forming the middle layer 530*c*. Accordingly, it is possible to prevent the center chip 50*c* from separating if exposed to a cold environment in an internal combustion engine.

Figure 9:
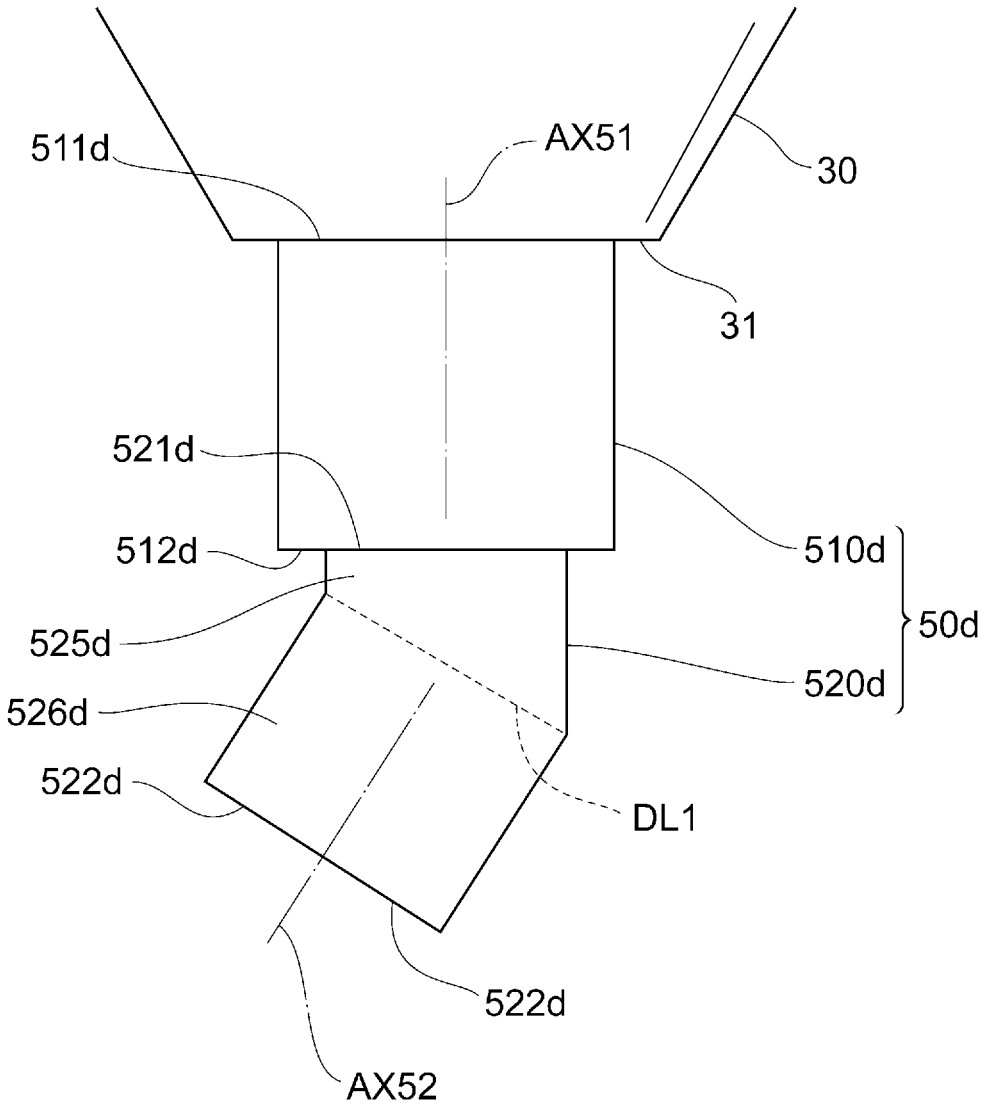
FIG. 9 shows a perspective view of center chip of a spark plug according to a fifth embodiment of the present disclosure.

Referring to FIG. 9, a fifth embodiment will be described below. A spark plug 100 according to the fifth embodiment is different from the first embodiment in only a shape of a center chip 50*d*. Other configurations are the same as those in the first embodiment. Different points in the fifth embodiment compared to the first embodiment will be described below.

The center chip 50*d* has a first part 510*d* and a second part 520*d*. A shape of the first part 510*d* of the present embodiment has a square prism shape. An end face 511*d* of the first part 510*d* disposed at a position opposed to a center electrode 30 and an end face 512*d* of the first part 510*d* disposed at a position opposed to the second part 520*d* are both perpendicular to a center axis AX51 of the first part 510*d*.

A shape of the second part 520*d* according to the present embodiment has a square prism shape with a center axis being bent in the middle. A part (hereinafter referred to as a "vertical portion 525*d*") of the second part 520*d* on the first portion 510*d* side is formed so as to extend perpendicularly to the end face 512*d*. A center axis of the vertical portion 525*d* is aligned with the center axis AX51 of the first part 510*d*. In addition, a center axis AX52 of a part (hereinafter referred to as "inclined portion 526*d*") of the second portion 520*d* on the ground tip 60 side is inclined with respect to the central axis AX51. The center axis AX52 of the inclined portion 526*d* is aligned with a center axis AX60 of the ground chip 60 in the same way as a center axis AX52 of a second part 520 in the first embodiment. In addition, a tip end face 522*d* of the inclined portion 526*d* is perpendicular to the center axis AX52 of the inclined portion 526*d*, and is opposed to a tip end face 61 of the ground chip 60 in a mutually parallel. As shown in FIG. 9, a border line between the vertical portion 525*d* and the inclined portion 526*d* is illustrated by a dotted line DL1.

Materials of the vertical portion 525*d* and the inclined portion 526*d* may also be the same as each other or be different from each other. For example, the inclined portion 526*d* may also be made of a noble metal alloy including platinum as a base material, and the vertical portion 525*d* may also be made of the same material (alloy including nickel as a base material) as the first part 510*d*.

Like the present embodiment, even when only the tip end of the second part 520*d* is non-perpendicular to the center axis AX51 of the first part 510*d*, not the entire second part 520*d*, an effect similar to one described in the first embodiment may be obtained. Incidentally, a shape of the vertical portion 525*d* may also be different from it shown in FIG. 9.

Figure 10:
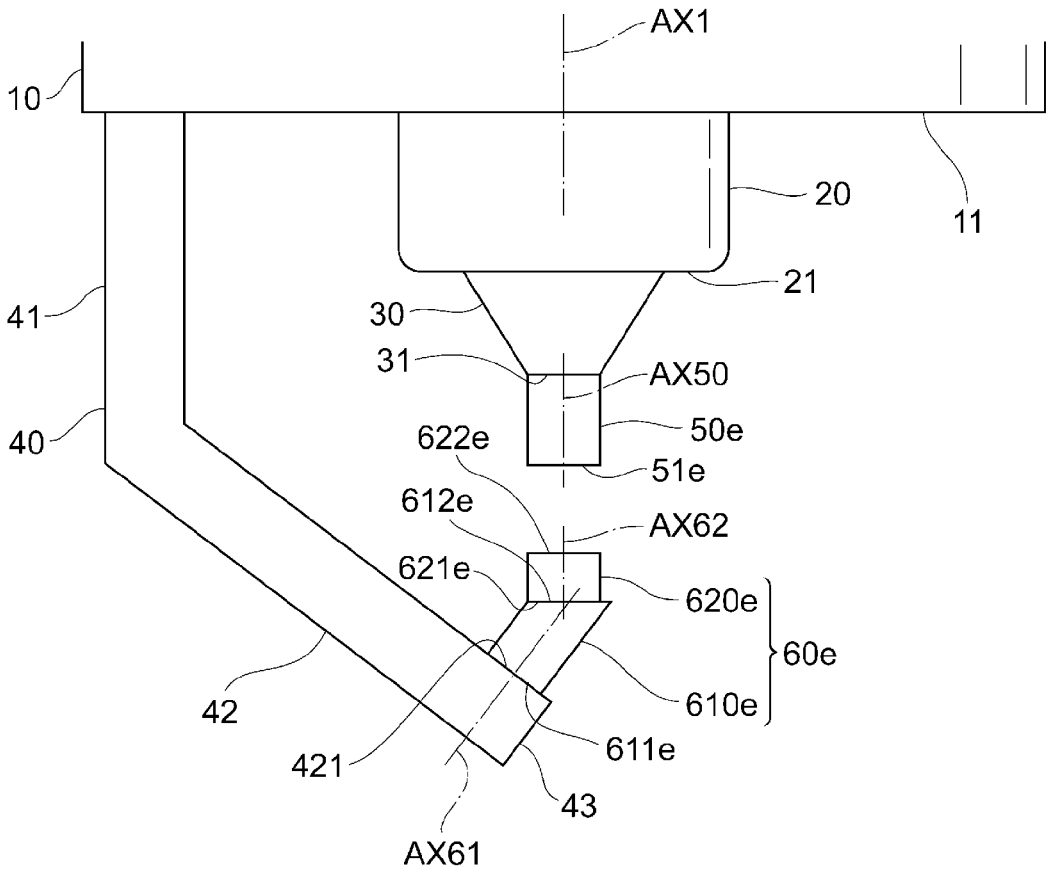
FIG. 10 shows an enlarged view of a part of occurring spark discharge in a spark plug according to a sixth embodiment of the present disclosure.

Referring to FIG. 10, a sixth embodiment will be described below. A spark plug 100 according to the sixth embodiment is different from the first embodiment in only shapes of a center chip 50*e* and a ground chip 60*e*. Other configurations are the same as those in the first embodiment. Different points in the sixth embodiment compared to the first embodiment will be described below.

The shape of the center chip 50*e* according to the present embodiment is the same as that of the ground chip 60 in the first embodiment. That is, the center chip 50*e* has a cylindrical shape, and a center axis AX50 thereof is perpendicular to a tip end face 31 of a center electrode 30. The center axis AX50 of the center chip 50*e* is aligned with a center axis AX1 of a mounting fitting 10. A tip end face 51*e* of the center chip 50*e* disposed at a position opposed to the ground chip 60*e* is perpendicular to the center axis AX50 of the center chip 50*e*.

The shape of the ground chip 60*e* is the same as that of the center chip 50 in the first embodiment. That is, the ground chip 60*e* includes a first part 610*e* and a second part 620*e* which are bonded with each other. Thereby, the ground chip 60*e* has a cylindrical shape so that a center axis thereof is bent in the middle.

The first part 610*e* is a ground electrode 40 side part of the ground chip 60*e*, and is bonded with a side face 421 of the ground electrode 40. The first part 610*e* has an approximately cylindrical shape. The first part 610*e* linearly extends from the side face 421 of the ground electrode 40 along a center axis AX61 of the first part 610*e*.

An end face 611*e* (i.e. an end face which is disposed apart from the second part 620*e*) of the first part 610*e* disposed at a position opposed to the ground electrode 40 is perpendicular to the center axis AX61 of the first part 610*e*. The first part 610*e* is welded and fixed in such a state that the end face 611*e* of the first part 610*e* is disposed on the side face 421 of the ground electrode 40. As a result, the first part 610*e* is connected with the side face 421 of the ground electrode 40 so that the center axis AX61 thereof is perpendicular to the side face 421 of the ground electrode 40.

An end face 612*e* of the first part 610*e* disposed at a position opposed to the second part 620*e* is non-perpendicular to the center axis AX61 of the first part 610*e*. In addition, the end face 612*e* of the first part 610*e* is perpendicular to the center axis AX50 of the center chip 50*e*. In other words, the end face 612*e* of the first part 610*e* and the tip end face 31 of the center electrode 30 face each other and are mutually parallel.

The second part 620*e* is a part of the ground chip 60*e* disposed at the center chip 50*e* side, and has a cylindrical shape. The second part 620*e* linearly extends from the end face 612*e* of the first part 610*e* along a center axis AX62 of the second part 620*e*. Both an end face 621*e* of the second part 620*e* at a position opposed to the first part 610*e* and a tip end face 622*e* of the second part 620*e* disposed at the center chip 50*e* side are perpendicular to the center axis AX62 of the second part 620*e*. The center axis AX62 of the second part 620*e* is aligned with the center axis AX50 of the center chip 50. Therefore, the tip end face 622*e* of the second part 620*e* and the tip end face 51*e* of the center chip 50*e* face each other in a mutually parallel.

In the above-described configuration, the ground electrode 40 side part of the ground chip 60*e*, that is the first part 610*e*, which is a part welded to the ground electrode 40, is perpendicular to the side face 421 of the ground electrode 40. Therefore, welding the ground chip 60*e* to the ground electrode 40 may be relatively easily performed. That is, in the present embodiment, an effect similar to one described in the first embodiment may be obtained.

Figure 11:
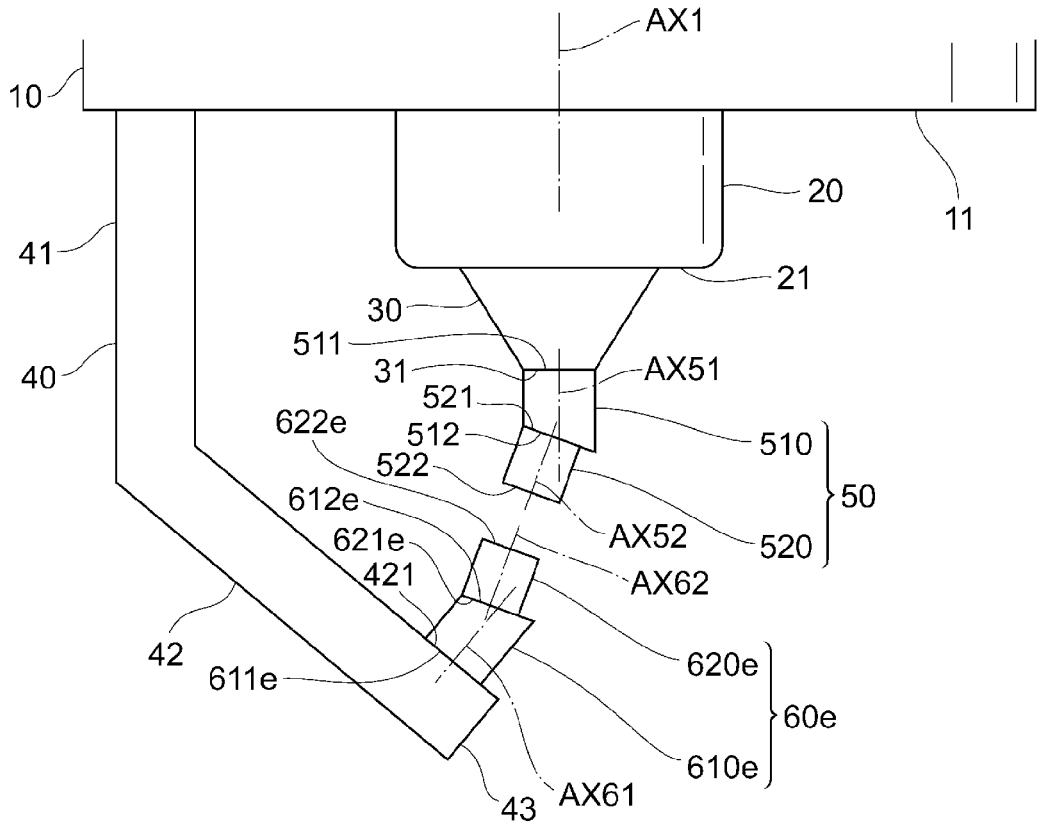
FIG. 11 shows an enlarged view of a part of occurring spark discharge in a spark plug according to a seventh embodiment of the present disclosure.

Referring to FIG. 11, a seventh embodiment will be described below. A spark plug 100 according to the seventh embodiment is different from the first embodiment in only shapes of a center chip and a ground chip. Other configurations are the same as those in the first embodiment. Different points in the seventh embodiment compared to the first embodiment will be described below.

The shape of the center chip of the present embodiment is approximately the same as that of the center chip 50 in the first embodiment (refer to FIG. 2). Accordingly, the center chip of the present embodiment is also indicated as "center chip 50". The center chip 50 has a first part 510 and a second part 520. In the center chip 50 of the present embodiment, an angle formed by a center axis AX51 of the first part 510 and a center axis AX52 of the second part 520 is slightly larger than that of the first embodiment. That is, a bending degree of the center chip 50 is slightly smaller than one shown in FIG. 2 in the first embodiment.

The shape of the ground chip of the present embodiment is approximately the same as that of the ground chip 60*e* in the sixth embodiment (refer to FIG. 10). Accordingly, the ground chip of the present embodiment is also indicated as "ground chip 60*e*". In the ground chip 60*e* of the present embodiment, an angle formed by a center axis AX61 of a first part 610*e* and a center axis AX62 of a second part 620*e* is slightly larger than one of the sixth embodiment. That is, a bending degree of the ground chip 60*e* is slightly smaller than one shown in FIG. 10 in the sixth embodiment. Accordingly, the center axis AX52 of the second part 520 is aligned with the center axis AX62 of the second part 620*e*. In addition, a tip end face 522 of the center chip 50 and a tip end face 622*e* of the ground chip 60*e* face each other and are mutually parallel.

In the above-described configuration, a part of the center chip 50 disposed at a center electrode 30 side, which is welded to the center electrode 30, is perpendicular to a tip end face 31 of the center electrode 30. Therefore, welding the center chip 50 to the center electrode 30 may be relatively easily performed. That is, in the present embodiment, an effect similar to one described in the first embodiment may be obtained.

A ground electrode 40 side part of the ground tip 60*e*, that is, a shape of a part of the first portion 610*e*, which is a part welded to the ground electrode 40, is perpendicular to the side face 421. Therefore, welding the ground chip 60*e* to the ground electrode 40 may be relatively easily performed. That is, in the present embodiment, an effect similar to one described in the sixth embodiment may be obtained.

Figure 12:
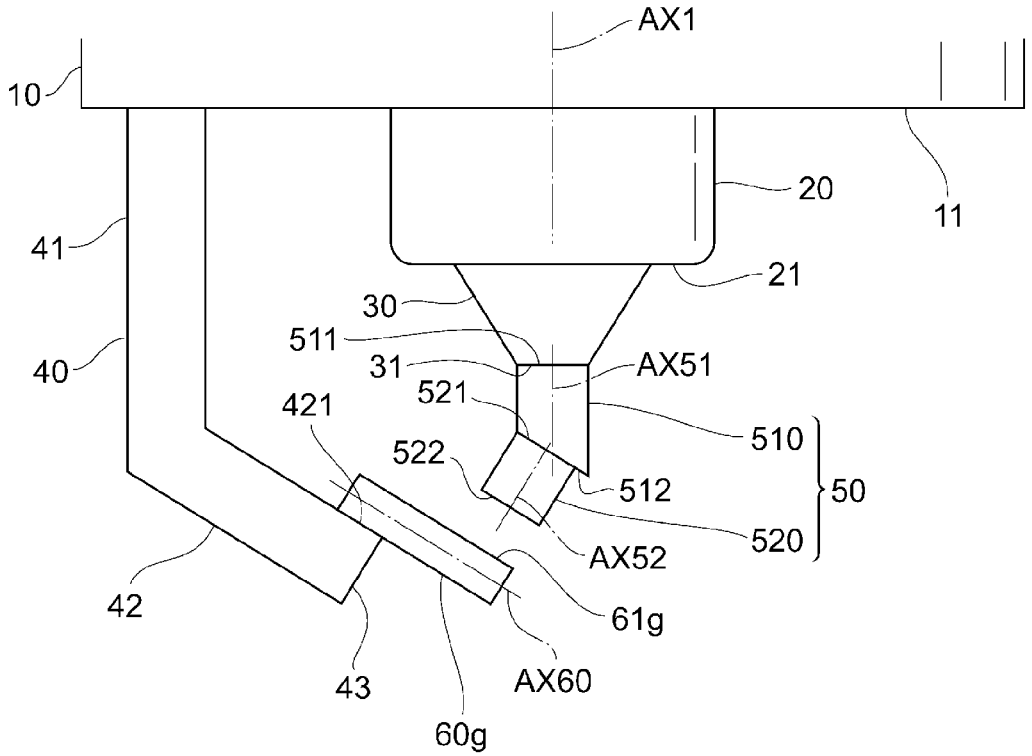
FIG. 12 shows an enlarged view of a part of occurring spark discharge in a spark plug according to an eighth embodiment of the present disclosure.

Referring to FIG. 12, an eighth embodiment will be described below. A spark plug 100 according to the eighth embodiment is different from the first embodiment in only shapes of a ground electrode and a ground chip 60*g*. Other configurations are the same as those in the first embodiment. Different points in the eighth embodiment compared to the first embodiment will be described below.

The shape of the ground electrode of the present embodiment is approximately the same as that of a ground electrode 40 in the first embodiment (refer to FIG. 2). Accordingly, the ground electrode of the present embodiment is also indicated as "ground electrode 40". The center chip 50 has a first part 510 and a second part 520. In the ground electrode 40 of the present embodiment, a length of a part (part number 42) extending from a mounting fitting 10 to a tip end 43 of the ground electrode 40 other than a part of the ground electrode 40 arranged parallel relative to a center axis AX51 of the first part 510 is shorter than one in the first embodiment. Therefore, when viewing the ground electrode 40 along the center axis AX52 of the second part 520, the second part 520 of the center chip 50 and the part given the reference numeral 42 of the ground electrode 40 are not overlapped with each other.

The ground chip 60*g* of the present embodiment has a square prism shape. The ground chip 60*g* has a first end and a second end. In the ground chip 60*g*, the first end is perpendicular to the second end. The side face in the first end of the ground chip 60*g* is welded to a side face 421 of the ground electrode 40. The second end of the ground chip 60*g* is projected from the tip end 43 of the ground electrode 40 to a center axis AX1 of a mounting fitting 10. A center axis AX60 of the ground chip 60*g* is perpendicular to the center axis AX52 of the second part 520. Accordingly, in the second end of the ground chip 60*g*, a side face 61*g* of the ground chip 60*g* and a tip end face 522 of the center chip 50 face each other and are mutually parallel. In the above-described aspect, an effect similar to one described in the first embodiment may be obtained.

Incidentally, a material of the ground chip 60*g* may also be a noble metal alloy including platinum or iridium as a base material, and may also be an alloy including nickel as a base material.

Figure 13:
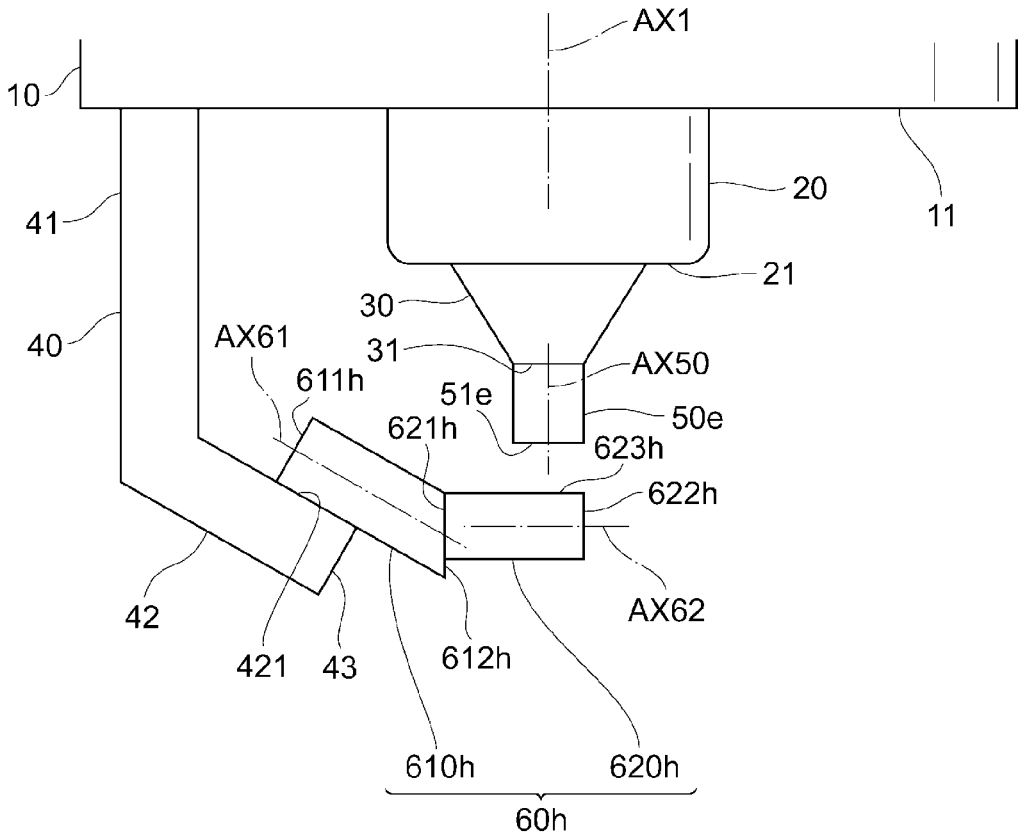
FIG. 13 shows an enlarged view of a part where spark discharge occurs in a spark plug according to a ninth embodiment of the present disclosure.

Referring to FIG. 13, a ninth embodiment will be described below. A spark plug 100 according to the ninth embodiment is different from the first embodiment in only shapes of a center chip, a ground electrode and a ground chip 60*h*. Other configurations are the same as those in the first embodiment. Different points in the ninth embodiment compared to the first embodiment will be described below.

The shape of the center chip of the present embodiment is the same as that of the center chip 50*e* in the sixth embodiment (refer to FIG. 10). Accordingly, the center chip of the present embodiment is also indicated as "center chip 50*e*".

The shape of the ground electrode of the present embodiment is approximately the same as that of the ground electrode 40 in the first embodiment (refer to FIG. 2). Accordingly, the ground electrode of the present embodiment is also indicated as "ground electrode 40". A length of a part (part number 42) extending from a mounting fitting 10 to a tip end 43 of the ground electrode 40 other than a part of the ground electrode 40 arranged parallel relative to a center axis AX50 of the center tip 50*e* is shorter than one in the first embodiment. Therefore, when viewing the ground electrode 40 along a center axis AX50 of the center chip 50*e*, the center chip 50*e* and the part given the reference numeral 42 of the ground electrode 40 are not overlapped with each other.

Figure 6:
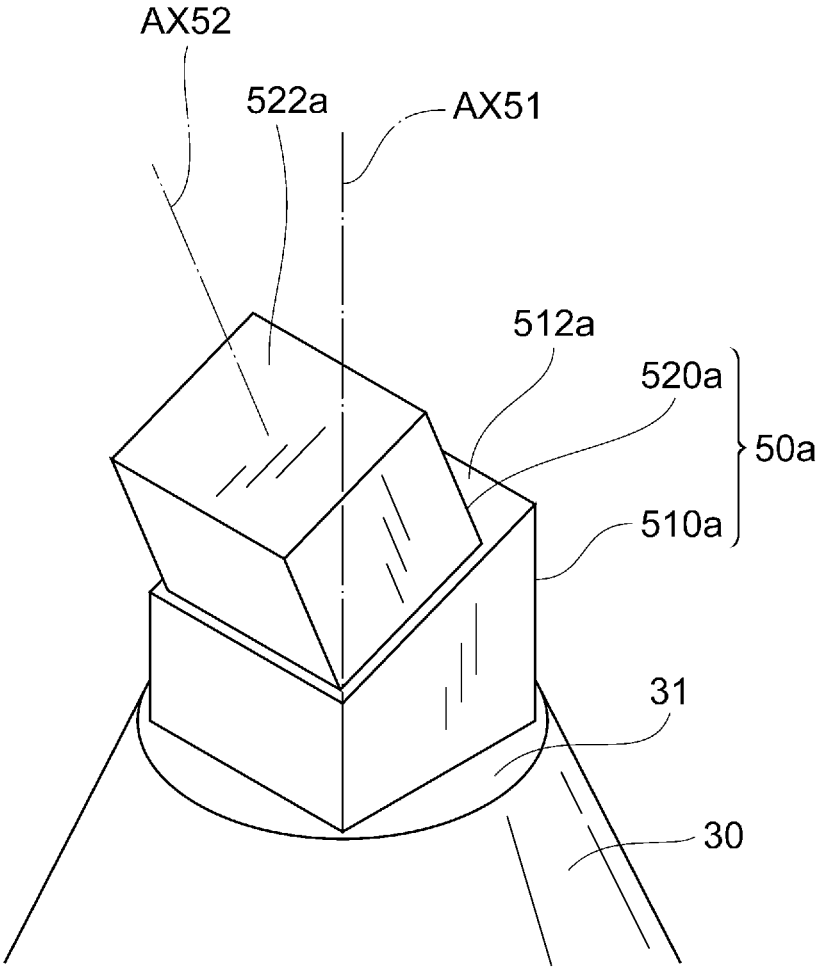
FIG. 6 shows a perspective view of a center chip of a spark plug according to a second embodiment of the present disclosure.

A shape of the ground chip 60*h* of the present embodiment is the same as that of the center chip 50*a* shown in FIG. 6 in the second embodiment. The ground chip 60*h* is formed by diffusion bonding a first part 610*h* with a second part 620*h*. The ground chip 60*h* has a square prism shape such that a center axis thereof is bent in the middle.

The first part 610*h* is a part of the ground chip 60*h* disposed at the ground electrode 40 side part of the ground chip 60*h*. A side face of the first part 610*h* is welded and fixed to a side face 421 of the ground electrode 40 in such a state that a center axis AX61 of the first part 610*h* and a part (part number 42) of the ground electrode 40 face each other and are mutually parallel. An end face 612*h* of the ground chip 60*h* disposed opposed to the second part 620*h* is non-perpendicular to the center axis AX61 of the first part 610*h*, and is arranged parallel relative to a center axis AX1 of a mounting fitting 10. In addition, in the ground chip 60*h*, an end face 611*h* of the first part 610*h*, which is opposed to the end face 612*h*, is perpendicular to the center axis AX61 of the first part 610*h*.

The second part 620*h* linearly extends from the end face 612*h* of the first part 610*h* along a center axis AX62 of the second part 620*h*. Both a side face 621*h* of the second part 620*h*, which is opposed to the first part 610*h*, and a tip end face 622*h* of the second part 620*h*, which is opposed to the side face 621*h* of the second part 620*h*, are perpendicular to the center axis AX62 of the second part 620*h*.

The center axis AX62 of the second part 620*h* is perpendicular to the center axis AX50 of the center chip 50*e*. Therefore, a side face 623*h* of the second part 620*h*, which is opposed to the center chip 50*e*, is perpendicular to the center axis AX50 of the center chip 50*e*. In addition, a tip end face 51*e* of the center chip 50*e* and the side face 623*h* of the second part 620*h* face each other and are mutually parallel. In a vicinity of the tip end face 622*h* of the second part 620*h*, the side face 623*h* of the second part 620*h* and the tip end face 51*e* of the center chip 50*e* face each other in a mutually parallel. In the above-described aspect, an effect similar to one described in the first embodiment may be obtained.

Figure 14:
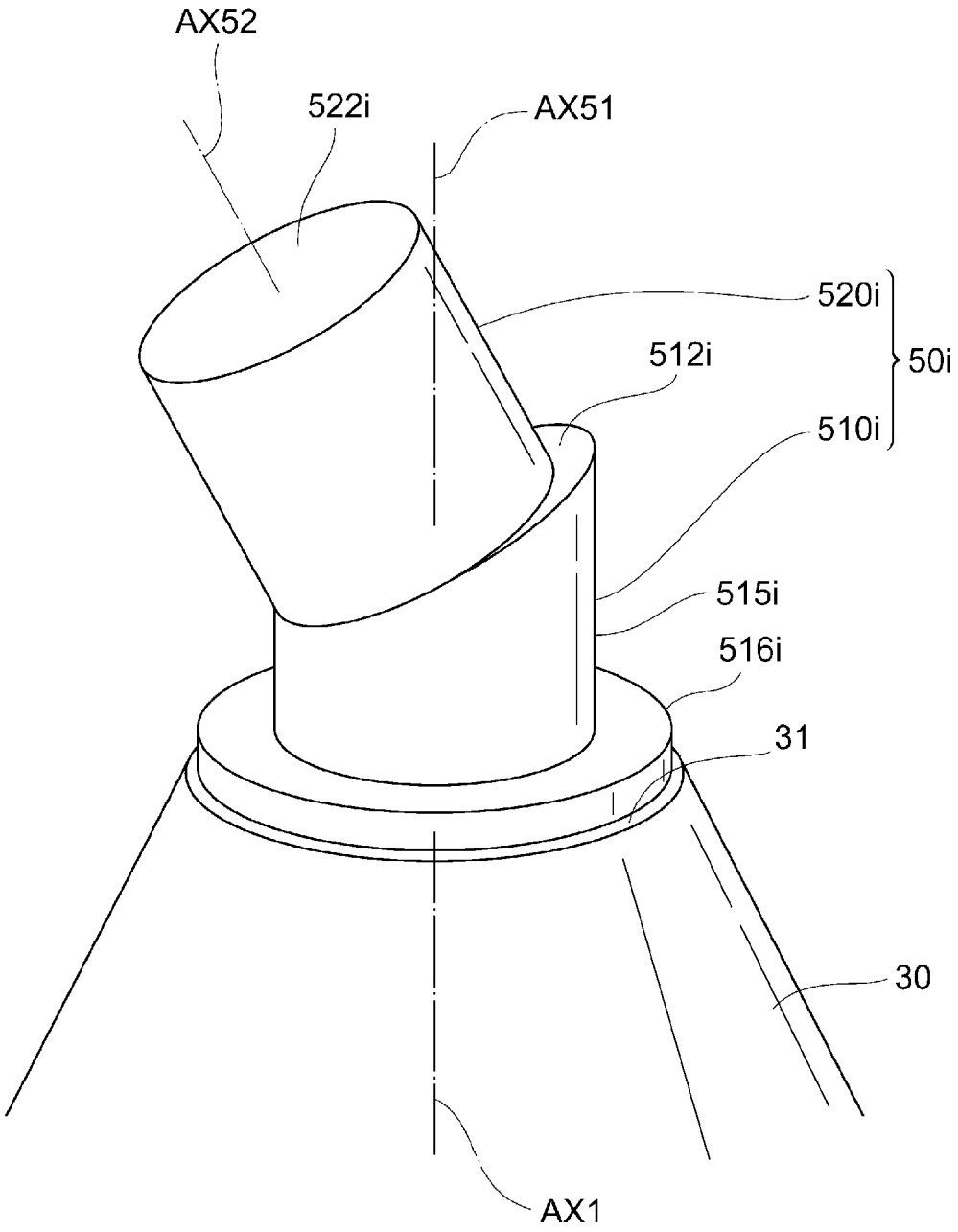
FIG. 14 shows a perspective view of a center chip of a spark plug according to a tenth embodiment of the present disclosure.

Referring to FIG. 14, a tenth embodiment will be describe below. A spark plug 100 according to the tenth embodiment is different from the first embodiment in only a shape of a center chip 50*i*. Other configurations are the same as those in the first embodiment. Different points in the tenth embodiment will be described below.

The center chip 50*i* has a first part 510*i* and a second part 520*i*. The first part 510*i* has a part given a reference numeral 515*i* and the diameter enlarged portion 516*i*. In the center chip 50*i* of the present embodiment, the diameter enlarged portion 516*i* is formed on a center electrode 30 side part of the first part 510*i*. The part given the reference numeral 515*i* has a first end face and a second end face facing each other. The diameter of the diameter enlarged portion 516*i* is larger than that of the first end face which is opposed to the diameter enlarged portion 516*i*. The diameter enlarged portion 516*i* is disposed at a position which is closest to the center electrode 30 in the first part 510*i*. A center axis of the diameter enlarged portion 516*i* is aligned with a center axis AX51 of the part given the reference numeral 515*i* and a center axis AX1 of a mounting fitting 10.

Incidentally, the part given the reference numeral 515*i* of the first part 510*i* has a diameter slightly smaller than the diameter of a first part 510 of the first embodiment. In addition, the second part 520*i* has a diameter one size smaller than the diameter of a second part 520 of the first embodiment.

In this way, in an aspect where diameters of the first end face and the second end face are both different from those of the diameter enlarged portion 516*i* and the second part 520*i*, an effect similar to one described in the first embodiment may be obtained.

As described above, referring to concrete examples, embodiments of the present disclosure has been described. However, the present disclosure is not limited to these concrete examples. That is, as long as items where those skilled in the art appropriately add design change to the concrete examples include the features of the present disclosure, they are included in the scope of the present disclose. For example, the above-described element, and a position, a material, a condition and a shape of the element included in each of the concrete examples may be appropriately changed, and are not limited to those illustrated. In addition, elements included in each of the embodiments can be combined as long as technically feasible, and are within the scope of the present disclosure as long as they include the features of the present disclosure.

What is claimed is:

1. A spark plug for an internal combustion engine, comprising:

a mounting fitting which has a cylindrical shape;

a center electrode which is disposed along a center axis of the mounting fitting, and the center electrode is mounted on the mounting fitting and electrically insulated from the mounting fitting;

a center chip which is projected from a part of the center electrode to outside of the spark plug;

a ground electrode which has a first end and a second end, the first end being fixed to the mounting fitting, and at least a part of the ground electrode is non-perpendicular to the center axis of the mounting fitting so that the ground electrode becomes closer to the center axis of the mounting fitting towards the second end; and a ground chip which is mounted so as to project from a part of the ground electrode to the center chip, wherein at least one of the center chip and the ground chip has a first part bonded with the center electrode or the ground electrode and is formed so as to linearly extend along a first center axis of an electrode bonded with the first part; and a second part formed so as to extend linearly from a tip end of the first part along a second central axis inclined with respect to the first central axis.

2. A spark plug as set forth in claim 1, wherein, a first end face of the first part at an opposite side of the second part is perpendicular to the first axis.

3. A spark plug as set forth in claim 2, wherein, a material of the first part is different from that of the second part.

4. A spark plug as set forth in claim 3, wherein, end faces formed on both ends of the second part are perpendicular to the second center axis.

5. A spark plug as set forth in claim 3, wherein, a middle layer made of a material different from both of the materials of the first part and the second part is formed between the first part and the second part.

6. A spark plug as set forth in claim 5, wherein, a linear expansion coefficient of the middle layer is smaller than that of the first part, and is larger than that of the second part.

7. A spark plug as set forth in claim 3, wherein, the first part is made of an alloy including nickel, and the second part is made of a noble metal alloy.

8. A spark plug as set forth in claim 7, wherein, the noble metal alloy is an alloy including platinum or iridium.

* * * * *